US006082529A

United States Patent [19]

DeLuca et al.

[11] Patent Number: 6,082,529

[45] Date of Patent: Jul. 4, 2000

[54] AMMUNITION PACKAGING

[75] Inventors: Peter L. DeLuca, Bermuda Dunes; Enrico R. Mutascio, Palm Springs; Everett L. Aplet, Palm Desert, all of Calif.

[73] Assignee: Armtec Defense Products Co., Coachella, Calif.

[21] Appl. No.: 09/123,244

[22] Filed: Jul. 27, 1998

Related U.S. Application Data

[60] Provisional application No. 60/054,963, Aug. 7, 1997.

[51] Int. Cl.[7] ..... B65D 85/20; B65D 73/00

[52] U.S. Cl. ..... 206/3; 206/486; 229/406

[58] Field of Search ..... 206/3, 443, 486; 229/406, 407

[56] References Cited

U.S. PATENT DOCUMENTS

| | | | |
|---|---|---|---|
| 260,153 | 6/1882 | Bennett | 206/3 |
| 2,346,792 | 4/1944 | Rush | 206/3 |
| 3,885,727 | 5/1975 | Gilley | 229/407 |
| 3,894,679 | 7/1975 | Reifers et al. | 229/407 |
| 3,986,655 | 10/1976 | Rynning | 229/229 |
| 4,036,103 | 7/1977 | Gawlick et al. | 206/3 |

*Primary Examiner*—Jim Foster
*Attorney, Agent, or Firm*—Sheridan Ross P.C.

[57] ABSTRACT

Molded pulp inner protective packaging for ammunition is provided. The packaging can be formed using a single molding operation without the need for drilling, punching or similar subsequent operations. Molded-in holes with sufficient precision to achieve reliable interference fit against ammunition is provided. In some cases, the single piece device includes flaps or other extensions foldable to provide support in two or more places for the ammunition. In one embodiment, precisely dimensioned rods extending from a substrate through a forming screen are used in producing molded-in holes of precise dimension.

19 Claims, 6 Drawing Sheets

AMMUNITION PACKAGING

This application claims the benefit of U.S. Provisional Application No. 60/054,963, filed Aug. 7, 1997.

The present invention relates to packaging for ammunition and in particular to a molded pulp packaging component having multiple openings for receiving ammunition.

BACKGROUND INFORMATION

Although some types of ammunition, particularly small caliber ammunition such as .22 caliber ammunition and shot shell ammunition, may be packaged loose in a container, e.g. with cartridges touching one another, in many situations it is preferred to provide packaging in which cartridges are spaced from one another, preferably aligned in parallel rows, all in the same orientation. Spaced-apart ammunition is believed to be preferable for safety concerns and to avoid impacts which could damage cartridges, leading to mis-fires. Packaging in such orientation is also believed to assist the user in more quickly loading a fire arm and is believed to present a more pleasing appearance to the consumer.

A number of previous packaging approaches have used plastic holders which define a plurality of collars for receiving cartridges or portions thereof. Typically, such plastic holders are not readily bio-degradable and thus packaging which may be e.g. left in the field may have an adverse environmental impact. Additionally, even when packaging is carried back from the field, the plastic components typically used for this type of packaging are not readily recyclable.

A number of previous designs have provided for plastic packaging components that are shaped such that they do not provide nestable stacking, i.e. so that they take up a relatively large volume for storage or shipping. This is particularly true when the packaging involves plastic foam components.

Another previous approach to ammunition packaging has involved providing a multipiece grid of rectangular slotted cardboard pieces. Such grids typically are collapsible for shipment or storage and are more readily bio-degradable and recyclable than many types of plastic packaging. Unfortunately, such grids typically require several multiple-fabricated pieces for construction, thus requiring several steps, making them uneconomical in a number of situations. Furthermore, by providing for a grid, typically of squares, which receive typically round cross-section cartridges, the cartridges are contacted only along the portion of their circumference thus providing very limited cushioning of the cartridges against impact, vibrations and the like. Additionally, the square-holed grids provide only a loose fit, potentially permitting cartridges to be vibrated free from their intended positions.

Certain types of ammunition packaging lose some of their close-fit properties on use (i.e. on initial withdraw of a cartridge from its position) so that full reusability is not possible (i.e. reinserting the cartridge after it has been withdrawn from the packaging results in a relatively loose fit).

Accordingly, it would be useful to provide ammunition packaging which is bio-degradable and/or recyclable, provides nestable stacking, provides a high degree of cushioning, achieves a precise fit with regard to the cartridges and/or provides for full reusability, preferably multiple-time reusability.

SUMMARY OF THE INVENTION

The present invention is directed to molded pulp packaging for ammunition, preferably, paper or fiber pulp packaging, which provides benefits of being substantially bio-degradable and recyclable, and is able to achieve a relatively tight fit for receiving and retaining cartridges, at a reasonable cost. In one embodiment, costs are maintained relatively low when the packaging is provided by molding the entirety of the inner packaging material in a single piece without the need for forming steps in addition to molding, e.g. without the need for hole punching, drilling, reaming, cutting, trimming and the like (although folding and attaching may be used in some configurations). By providing for secure retention without the need for-collar formation and/or without the need for plastic foam or other spacing materials, the entire inner packaging device may be formed so as to accommodate stacking, preferably nestable stacking, to reduce or minimize shipping or storage volume. The shock and vibration absorbing qualities of the pulp material, preferably combined with a tight fit against the cartridges results in restraining and cushioning the ammunition and avoids dislodging or shifting e.g. during transit, while allowing easy removal. Moreover, the density of the molded pulp is relatively readily controlled, within limits, during manufacturing to provide different levels of cushioning and/or tightness of fit e.g. for different applications. In one embodiment holes or other regions for receiving portions of the cartridges are initially formed in an under-sized configuration so that the pulp material slightly deforms as cartridges are positioned in the packing material. Preferably the deformation is at least partially resilient such that the friction or interference fit achieved when cartridges are initially positioned in the packing material can be at least partially repeated when the cartridges are removed and then reinserted into the packing material, providing for substantial reusability of the packing material while retaining a degree of interference or friction fit.

DETAILED DESCRIPTION OF THE PREFERRED EMBODIMENT

Figure 1:
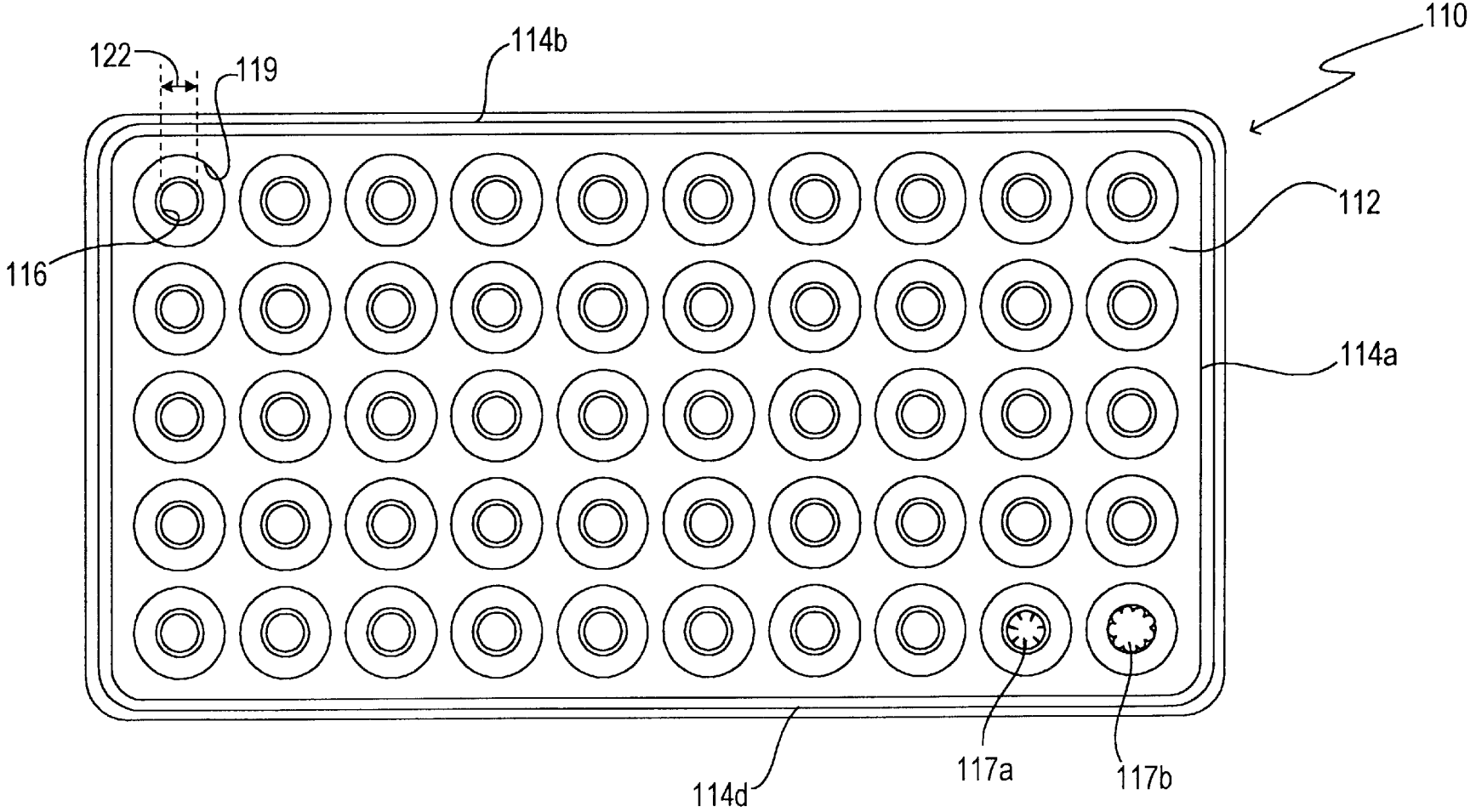
FIG. 1. is a top plan view of a packing device according to an embodiment of the present invention.
Figure 2:
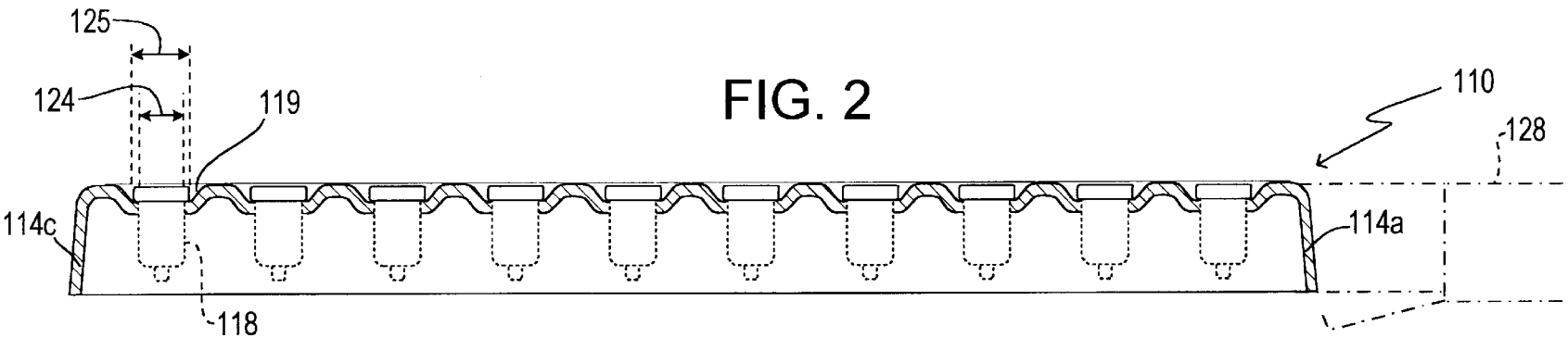
FIG. 2. is a lateral cross-sectional view of the device of FIG. 1 showing its relation to exterior packaging.

FIGS. 1 and 2 depict as-molded inner packing materials formed of pulp, such as paper or other fiber pulp (e.g. made from recycled newsprint) according to an embodiment of the present invention. In the depicted embodiment, an upper surface 112 is coupled to four side walls 114*a,b,c,d*. The upper surface 112 has a plurality of holes 116 molded therein. The holes are sized and shaped to receive portions of cartridges 118 such as for receiving body portions of cartridges with rimmed sections positioned above or, preferably received in recesses 119 formed in the upper surface 112 as shown in FIG. 2. Preferably, the holes 116 are sized to not only receive the cartridges but to hold or retain them in place against vibration, impact, and/or gravity or other forces that may tend to dislodge the cartridges. In one embodiment this is achieved by forming the holes 116 with a diameter 122 slightly smaller than the diameter 124 of portion of the cartridges 118 which the holes are to receive. In one embodiment, the cartridge 118 (e.g. a 0.38 special center-fire, rimmed pistol cartridge) has a diameter of about 9.63 mm, while the corresponding hole 116 has a diameter of about 9.50 mm. As can be seen from this example, the holes 116 are preferably formed with a relatively precise diameter, such as having a precision of within about 0.05 mm. It is believed that many previous hole forming procedures were unable to achieve this type of precision for as-formed or as-molded holes and, accordingly, the precision desired for the present application would have required, in previous systems, a separate hole-forming or finishing operation such as a drilling, punching, or reaming operation or the like, undesirably adding to packaging costs.

Because the holes 116 are preferably slightly smaller than the diameter of the cartridges they are to receive, the holes are slightly deformed outwardly when the cartridges are inserted. The resultant tight fit achieves an interference or friction force sufficient to retain cartridges in the desired location despite the type of vibration, impact or other movement or jostling normally expected during transport and/or use of the packaged cartridges.

Preferably, the pulp material has sufficient resiliency that, upon withdraw of the cartridge 118, the edge of the corresponding hole 116 as least partially springs back to define a hole 116 somewhat smaller than the diameter of the cartridge 118 that was just removed. In this way, a removed cartridge may be reinserted without losing the interference or friction fit so that the packing material can be reused, preferably many times, while still achieving the desired retention or holding characteristics.

Typically, the inner packing material 110 will be positioned within a cardboard or other box 128 for transport, display, sale, storage and the like.

Figure 3:
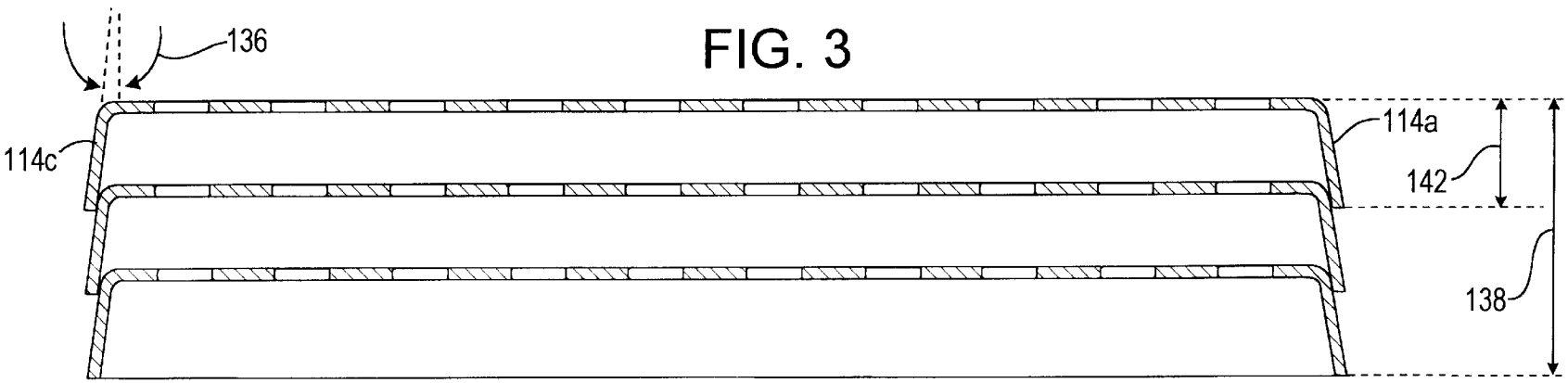
FIG. 3 is a lateral cross-sectional view of packaging material showing nestable stacking.
Figure 4:
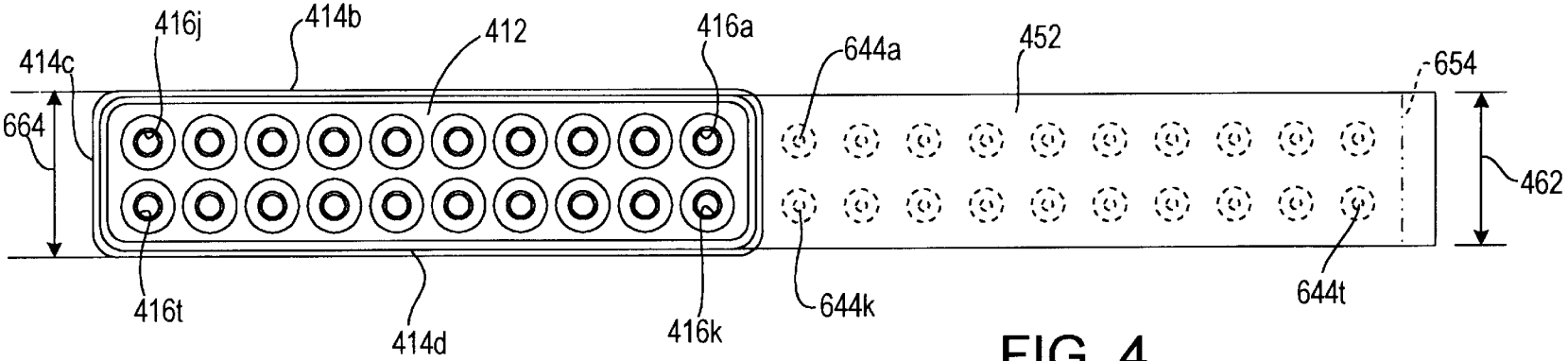
FIG. 4 is a top plan view of inner packing material according to an embodiment of the present invention.

In the embodiment of FIG. 3, the sidewalls 114*a*, 114*c* are preferably slightly angled outward 136 to accommodate nestable stacking in which, along at least one dimension (e.g. the vertical dimension in FIG. 3) the height 138 required for N packing units (N being equal to 3 in the illustration of FIG. 3) is substantially less than N x the height 142 of a single unit.

Although the configuration of FIGS. 1–3 can be used in connection with any of a plurality of types of cartridges or ammunition, it is believed likely that the configuration of FIGS. 1–3 (with cartridges supported at or adjacent the rims but unsupported at the noses thereof) would be typically used for packaging e.g. short-length rimmed or rimless centerfire pistol or rifle ammunition.

The embodiment of FIGS. 4–7 is anticipated to be used principally in connection with e.g. medium length rimmed or rimless center-fire pistol and rifle ammunition. In contrast with some previous packaging materials, such as plastic packaging, which at least sometimes provided cylindrical walls or collars extending along a substantial portion of the cartridge 618 of cartridges region which is relatively thin 642 such as having a thickness which is typically less than the diameter 624 of the cartridges, typically less than half the diameter and preferably less than one quarter of the diameter of the cartridge 618. As shown in the Figs. according to the present invention, collars can be avoided in any of the depicted configurations (FIGS. 1–9). In one embodiment, the thickness 642 is between about 1 and about 1.5 mm.

Figure 7:
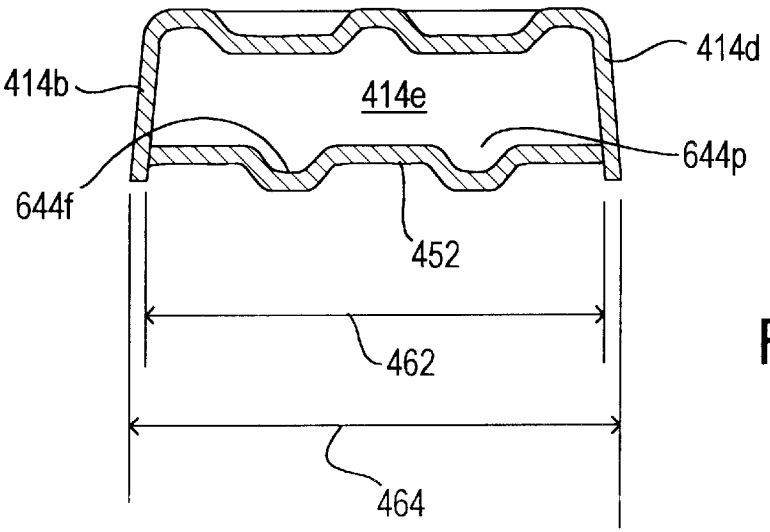
FIG. 7 is a cross-sectional view taking along line 7—7 of FIG. 6.

To provide the desired support, particularly for medium to long cartridges, without the need for a cylindrical sleeve formed in the packaging material, the configuration of FIGS. 4–7 provide a plurality of detents 644*a*–644*t* for receiving holding the noses of the cartridges 618 respectively aligned (in the folded configuration of FIG. 6) with upper surface holes 416*a*–416*t*. Although it may be operable to provide the inner packaging in two or more pieces, preferably the entire inner packaging is formed as a single piece, as shown in FIGS. 4–7. In the embodiment of FIGS. 4–7, the inner packaging includes an upper surface 412, for sidewalls 414*a,b,c,d* and a foldable flap 452. The flap 452 has detents 644*a*–644*d* molded therein and preferably includes a molded-in score line 654 for defining an attachment tab 656 which may be attached to the inner surface of the third sidewall 414*c*, e.g. by glueing, stapling, or by providing a latch (e.g. tab and slot) or interference fit. Preferably the width 462 of the flap 452 is less than the width 464 defined by the second and fourth sidewalls 414*b*, 414*d* so that the flap 452 may be folded to reside between the sidewalls 414*b*, 414*d* as depicted in FIG. 7. As in the embodiment of FIGS. 1–3, it is preferable to form the sidewalls 414*a,b,c,d* angled or flared outwardly to accommodate nestable stacking of the packing units and attached flaps 452) for volume-efficient storage or transport.

Figure 8:
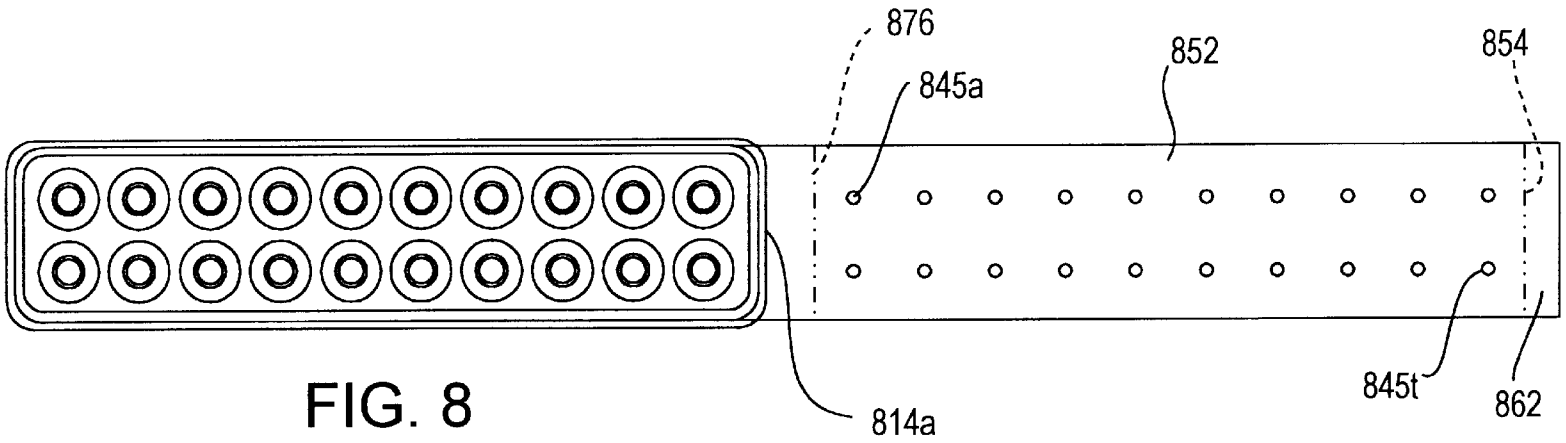
FIG. 8 is a top plan view of packing material according to an embodiment of the present invention in an unfolded configuration.
Figure 9:
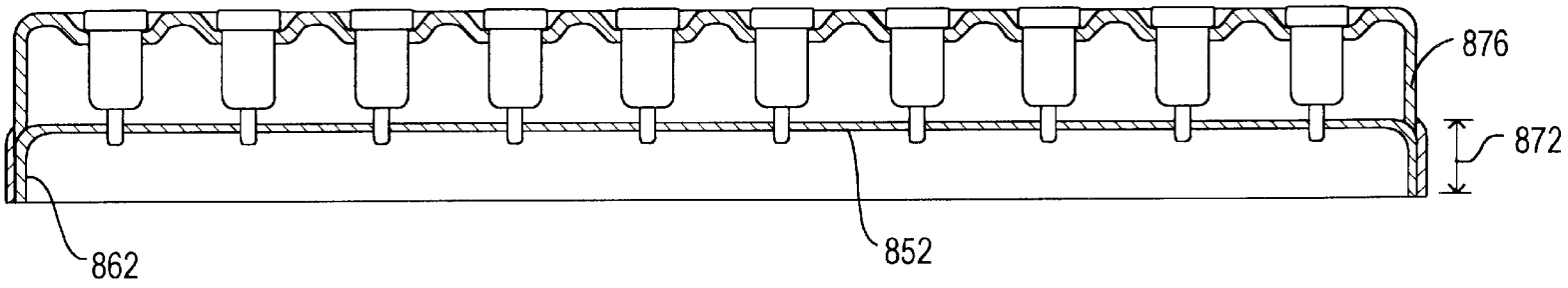
FIG. 9 is a longitudinal cross-sectional view of the packing material of FIG. 8 showing the packing material in a folded configuration.

FIGS. 8 and 9 depict a configuration which, it is anticipated, would typically be used in connection with packaging e.g. long-length rimmed or rimless center-fire pistol and rifle ammunition. As best seen in FIG. 9, the packaging of this embodiment differs from that of FIG. 6 principally in positioning the flap 852 a distance 872 above the bottom edge of the packaging and in providing the flap 852 with holes 845*a* 845*t* rather detents. In order to position the flap 852 as depicted in FIG. 9, the score 854 (which defines the attachment tab 862) is located on the opposite surface of the flap 852 such that the tab 862 projects downward in the embodiment of FIG. 9 (rather than upward as in the embodiment of FIG. 6). Further, an extension region 874, defined by an additional score line 876 is positioned between the first sidewall 814*a* and the main body of the flap 852. Preferably the embodiment of FIGS. 8 and 9 are configured, e.g. with angled or flaring sidewalls, to provide for nestable stacking, similar to that depicted for the embodiment of FIG. 5.

It is believed that, in general, previous molded pulp devices did not provide sufficient precision of the site of molded-in holes to achieve, e.g., the desired ammunition interference or friction fit.

Figure 5:
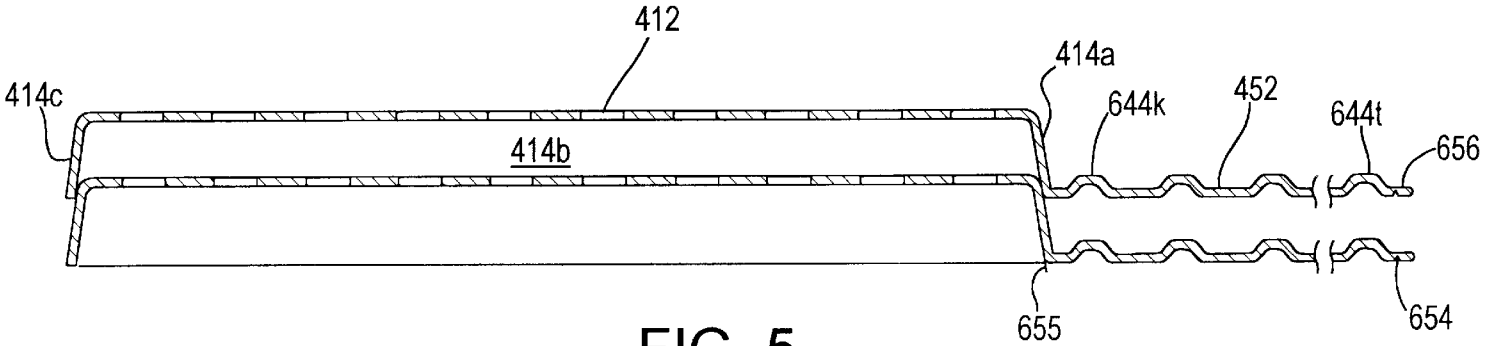
FIG. 5 is a lateral cross-sectional view showing nestable stacking of the packaging material of FIG. 4.
Figure 6:
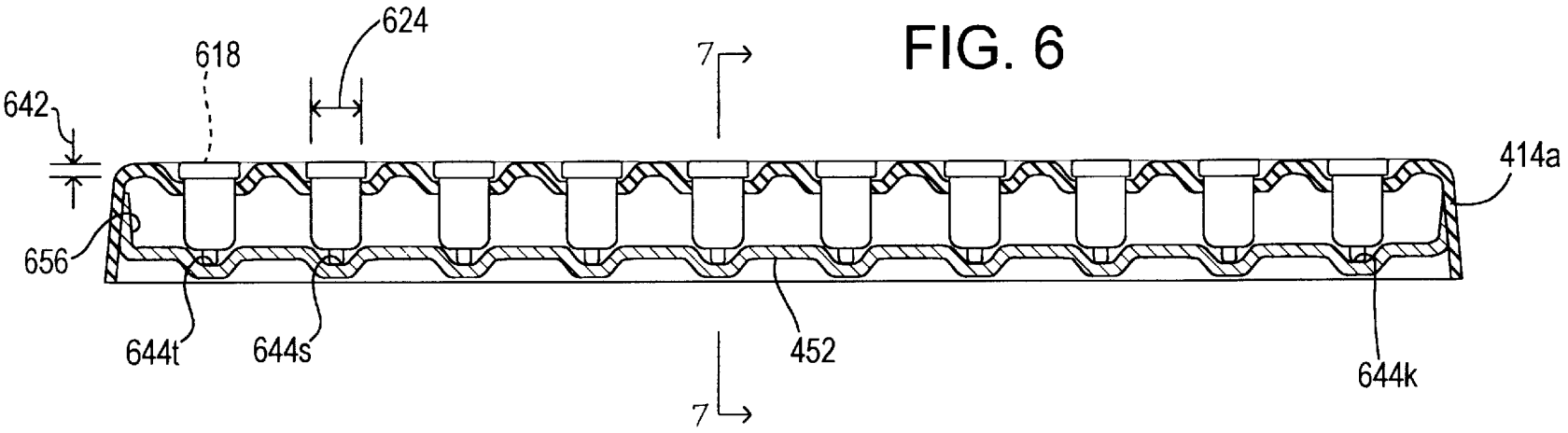
FIG. 6 is a longitudinal cross-section of the packing material of FIG. 4 showing the packing material in a folded configuration.
Figure 10:
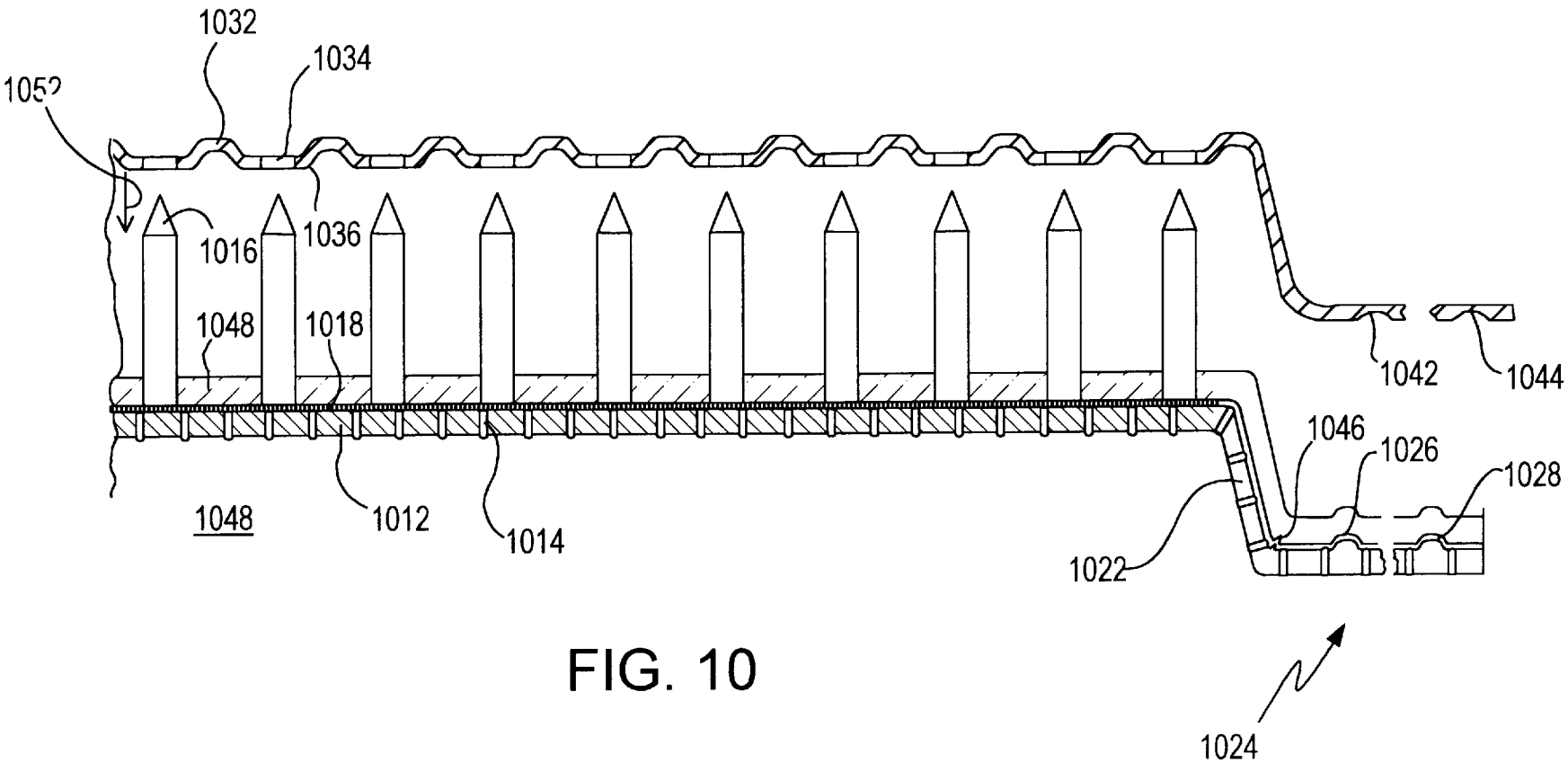
FIG. 10 is a partial cross-sectional view of a molding device and molded material according to an embodiment of the present invention.

FIG. 10 is a cross-sectional view depicting apparatus used for forming molded pulp items with high-precision molded-in holes. In the embodiment of FIG. 10, a metal substrate 1012 is provided having a plurality of holes or perforations therethrough 1014. Metal rods 1016 with the precise size and shape corresponding to that desired for the holes are mounted on the substrate 1012 in the desired positions. A fine-mesh wire screen 1018 is placed over the substrate 1012 with the metal rods projecting therethrough. Slopped or angled portions of the substrate and screen 1022 or a stepped portion 1024 with appropriate dimples 1026, 1028 for forming detents (as depicted in FIG. 5) may be provided. As will be clear to those of skill in the art upon understanding the present invention, the flap-forming portion 1024 may be provided with rods similar to rods 1016 in the main portion (e.g. for forming packaging as depicted in FIGS. 8 and 9) or the flap 1024 may be omitted if no flap portion is to be used (e.g. for forming packaging as depicted in FIGS. 1–3). Preferably, an upper mold plate 1032 is provided with close-fitting holes 1034 corresponding to the rods 1016 and with optional protrusions 1036 for forming recesses 119 in the upper surface e.g. for nesting ammunition rims, as described above. When the flap portion 1024 includes detent-forming dimples 1026, 1028, the upper mold is preferably provided with recesses 1042, 1044 corresponding the dimples 1026, 1028. Appropriately positioned ridges 1046 may be located either on the substrate and screen, as depicted in FIG. 10 or on the upper mold to provide score lines in desired locations and on desired surfaces for assisting in folding.

In use, a vacuum is applied to the interior 1048 of the forming mold while the mold is immersed in an aqueous slurry bath. The vacuum causes the slurry liquid to be drawn through the screen 1018 while the slurry solids (fibers) are mechanically separated or strained from the slurry liquid and accrete on the screen 1018 to form a fiber layer 1048. With the rods 1016 in place, the fiber layer 1048 forms around the rods in the cross-sectional shape and size of the rods. Although it is possible, in at least some embodiments, to form a useable molded-pulp device using only the lower portion 1012, 1018, 1016, in some embodiments, an upper mold 1032 is also provided, as described above, for pressing 1052 a fiber layer 1048 e.g. to increase the density thereof and/or form recesses using protrusions 1036 or portions of detents, e.g. using recesses 1042, 1044. The final density of the molded pulp product will depend on a number of factors including the fiber density and volume of the slurry, the use and/or pressure of the upper mold, and the strength and duration of the vacuum used. In general, it is believed that for the purpose of providing ammunition packaging, densities between about 0.3 grams per cubic centimeter and about 1.4 grams per cubic centimeter will be particularly useful. A number of factors influence the choice of density. Use of less dense, relatively soft material will provide greater damping of vibrations caused by external excitation and thus better cushioning. More dense material is, in general, stronger and stiffer and the vibration response will tend to increase.

In light of the above description, a number of advantages of the present invention can be seen. The present invention provides for packaging, such as interior packaging for ammunition which is substantially bio-degradable and recyclable but which nevertheless provides molded-in holes or other shapes with relatively high precision. The molded-in shapes preferably include holes with sufficiently precise dimensions to achieve firm friction or interference fit with the ammunition and preferably provides for sufficient resilience that a firm interference fit is achieved despite repeated use. The interior packing material can be configured to provide nestable stacking to decrease storage or transport volume and provide for high, preferably adjustable, vibration damping or other cushioning effects. Preferably the packing material can be recycled repeatedly, essentially indefinitely. The packing material provides impact cushioning, transport vibratory response and strength appropriate for packaging ammunition. The disclosed configurations achieve support of ammunition, including long ammunition, without the need for plastic foam or other spacing materials separate from the molded pulp packaging (although spacers can be used in conjunction with the molded packaging if desired). Configurations for supporting ammunition, including long ammunition, can be achieved from a single, sometimes foldable, piece, preferably a piece formed by a single molding operation, obviating the need for subsequent operations (such as stamping, drilling, reaming, trimming and the like). The device physically separates, restrains and cushions ammunition to prevent impact during package handling and transport. Preferably, the ammunition packaging is configured to fit into standard or already-existing exterior cardboard boxes. The interior packaging permits close control of hole dimensions to permit ammunition to be inserted into holes with a slight interference fit. Preferably the fit prevents the ammunition from dislodging or shifting during transit but allows easy removal by the user. Preferably the density of the molded pulp packaging material can be controlled to provide the desired level of transport cushioning and insertion interference.

A number of variations and modifications to the present invention can also be used. Packaging materials with a different number, configuration or distribution of holes than that depicted herein can be used, although packaging with at least two rows of holes is preferred. Holes with shapes other than circular can be provided such as round, elliptical, square, hexagonal and the like. Holes or openings may be provided with projections or scallops to assist in holding the ammunition in place 117*a*, 117*b*. Molded pulp packaging according to the present invention can be used in connection with packaging items other than ammunition, particularly where large quantities of small parts are packaged such as packaging of fasteners, specialty screws, cosmetics, electronic components and the like. Although FIGS. 4–9 depict packaging with two layers of support, additional support layers can be provided e.g. by appropriate flap extensions and/or scoring, or by providing separate pieces for attachment thereto. It is possible to use some aspects of the invention without using others such as by providing packaging material which provides a tight fit against molded-pulp holes but does not provide integral sidewalls or which provides precise hole dimensions in a molded pulp product but that does not provide folding score lines.

Although the present invention has been defined by way of a preferred embodiment and certain variations and modifications, other variations and modifications can also be used in the invention being defined by the following claims.

What is claimed is:

1. Packaging for ammunition cartridges, comprising:

a first surface having a plurality of holes therethrough, said holes sized and shaped to receive at least a first portion of said cartridges;

said first surface formed from molded pulp;

said holes being molded-in with a precision sufficient to form an interference fit with said cartridges for releasably retaining said cartridges in said holes;

a second surface positionable below said first surface;

at least a first sidewall coupled to said first surface, and wherein said first sidewall, first surface and second surface are integrally formed; and wherein said second surface is foldable from a storage position to a use position substantially parallel to said first surface.

2. Packaging as claimed in claim 1 wherein said pulp comprises paper pulp.

3. Packaging as claimed in claim 1 wherein said pulp is substantially recyclable.

4. Packaging as claimed in claim 1 wherein said pulp is substantially biodegradable.

5. Packaging as claimed in claim 1 further comprising at least a first leg extending downward from said first surface.

6. Packaging as claimed in claim 1 further comprising a second sidewall extending downward from said first surface.

7. Packaging as claimed in claim 6 wherein said first and second sidewalls are formed from molded pulp.

8. Packaging as claimed in claim 6 wherein said first and second sidewalls are angled with respect to said first surface to permit nestable stacking.

9. Packaging as claimed in claim 1 further comprising recessed regions in said first surface substantially surrounding said holes for accommodating rims of said cartridges.

10. Packaging as claimed in 1 further comprising at least one molded-in score line to facilitate folding of said second surface.

11. Packaging as claimed in claim 6, wherein said second surface is configured to fit between said first and second sidewalls.

12. Packaging, as claimed in claim 1 wherein said second surface comprises a plurality of detents for receiving nose portions of said cartridges.

13. Packaging, as claimed in claim 1 wherein said second surface comprises a plurality of holes for receiving nose portions of said cartridges.

14. Packaging as claimed in claim 1 wherein said holes are sized to deform outwardly in response to insertion of a cartridge.

15. Packaging as claimed in claim 14 wherein said molded pulp has sufficient resiliency that said holes relax to a smaller diameter after withdrawal of a cartridge therefrom, to provide for reusability while achieving retention.

16. Packaging as claimed in claim 15 wherein said reusability accommodates multiple uses.

17. Packaging for ammunition cartridges, comprising:

a first surface having a plurality of holes therethrough, said holes sized and shaped to receive at least a first portion of said cartridges;

said first surface formed from molded pulp;

said holes being molded-in with a precision sufficient to form an interference fit with said cartridges for releasably retaining said cartridges in said holes;

a second surface positionable below said first surface; and at least a first sidewall and wherein said second surface includes a tab for attachment to said sidewall.

18. Packaged ammunition comprising:

a plurality of ammunition cartridges;

a molded-pulp inner packaging configured for interference-fit retention of said plurality of ammunition cartridges; and an outer box substantially enclosing said ammunition cartridges and inner packaging.

19. A method for packaging ammunition comprising:

providing molded-pulp inner packaging having a plurality of holes configured for interference-fit retention of ammunition cartridges;

inserting an ammunition cartridge in at least some of said holes;

inserting said ammunition cartridges and inner packaging in an outer box.

* * * * *